United States Patent [19]

Perryman

[11] 4,230,032

[45] Oct. 28, 1980

[54] SPRAY BOOTH WITH VENTILATION

[76] Inventor: Albert A. Perryman, 11872 W. 207 St., Lakewood, Calif. 90715

[21] Appl. No.: 30,531

[22] Filed: Apr. 16, 1979

[51] Int. Cl.[3] ..... F23J 11/00

[52] U.S. Cl. ..... 98/115 SB; 118/326; 118/DIG. 7

[58] Field of Search ..... 98/115 SB; 118/326, 118/DIG. 7

[56] References Cited

U.S. PATENT DOCUMENTS

| | | | |
|---|---|---|---|
| 2,227,272 | 12/1940 | Peters | 98/115 SB |
| 2,257,516 | 9/1941 | Roche, Jr. et al. | 98/115 SB |
| 2,445,074 | 7/1948 | McCue | 98/115 SB |

*Primary Examiner*—Ronald C. Capossela

*Attorney, Agent, or Firm*—Dominick Nardelli

[57] ABSTRACT

In a paint spraying booth having a fresh air inlet at one end and an exhaust at the other end, the inlet end is provided with a solid end wall and a filtering wall parallelly spaced therefrom. Through the ceiling of the booth and in the region between the end wall and the filtering wall, one or more air-inlet vertically-disposed pipes is coupled. The lower end of the pipe terminates within the booth and between the end wall and the filtering wall while the upper end extends several feet upward above the ambient dust and dirt in the atmosphere. At the exhaust end, a pair of doors are provided and on each side of the doors are vertically disposed compartments having vertical filtering walls and being coupled to an overhead duct to expel the air into the atmosphere.

5 Claims, 4 Drawing Figures

3
32
31
34
33
13
14
12
15
44
11
42
44
43
3
4
65
63
61
12
18
62
21
21
67
4

12
51
13
33
13
15
34
31
32
16
52
13
63
65
62
13
66
64
11

51
34
41
33
32
31
42
13
43
18
44
21
21
44
21
15
16

64
13
66
21
64a
11
21
18
21
21

SPRAY BOOTH WITH VENTILATION

FIELD OF THE INVENTION

This invention relates to a surface treatment plant in which the objects to be treated or coated are placed within an enclosure and, more particularly, to a method of ventilating such enclosure with substantially clean air.

BACKGROUND OF THE INVENTION

Objects like, for example, automobile bodies, are placed within a paint spray booth in order to be sprayed with paint. Because of the degrading environmental effects paint spray has on the environment, the booths have to be open only on one end and on the back side, i.e., the opposite end from the open end, a suitable filtering and exhaust system has to be incorporated so that air moves at a steady rate from the open side to the back side and all the airborn hydrocarbons would be trapped in the filters before the air is expelled into the atmosphere. Although this system protects the environment, the auto body is not protected from airborn particles already in the atmosphere. These particles are objectionable because they would stick to the tacky painted surface whereby a good finish was impossible to obtain. As an improvement, the open side was covered with a filter so that the already airborn particles may be filtered out. After a while, one finds that the atmosphere is too dirty for these filters over the open side to be very effective.

OBJECTS OF THE INVENTION

An object of this invention is to provide a system for introducing air into a paint spray booth which air is cleaner and more particle-free than systems of the prior art.

Another object is to provide an enclosed appendage to the paint spray booth outside of the intake filters wherein the appendage has a vertically disposed inlet tube extending several feet above ground and, more particularly, several feet above the exhaust port for the booth.

These and other objects and features of advantage will become more apparent after studying the following description of the preferred embodiment of my invention, together with the appended drawing.

DETAILED DESCRIPTION OF THE DRAWING

Figure 1:
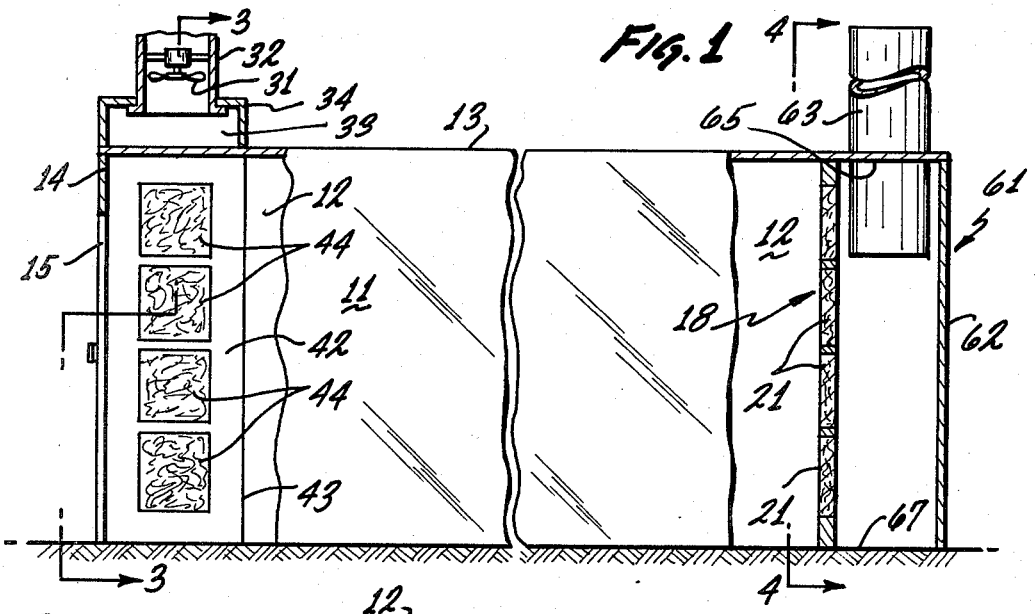
FIG. 1 is an elevation of my novel paint spray booth shown in partial section.
Figure 2:
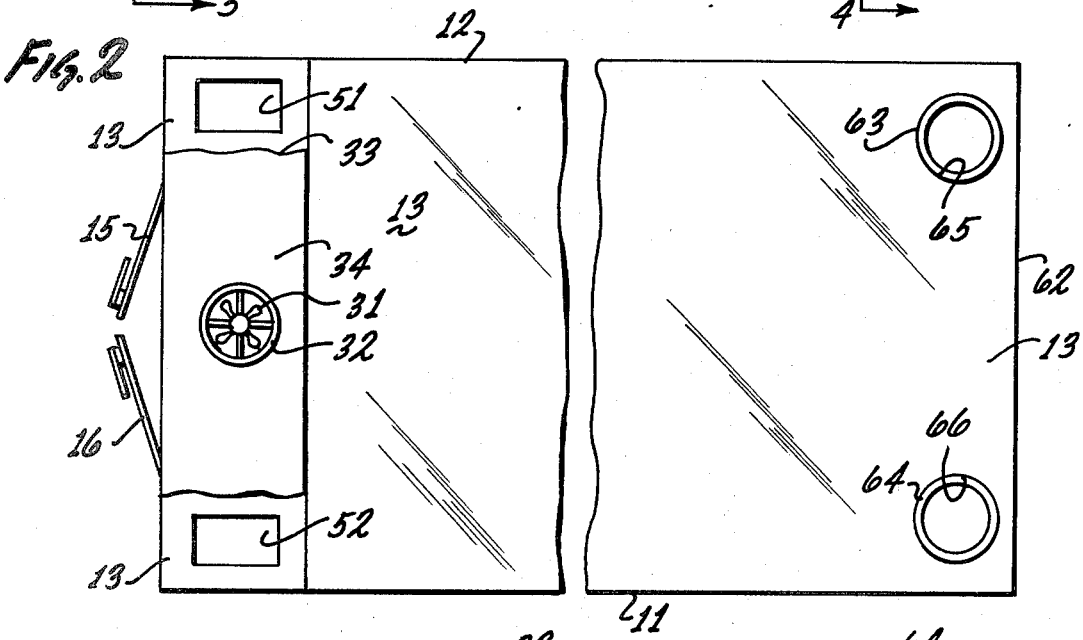
FIG. 2 is a plan view of the booth of FIG. 1 shown with the barn doors partially open.
Figure 3:
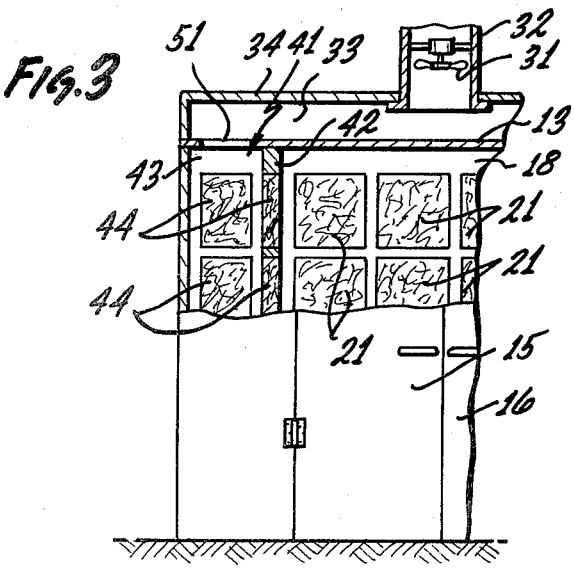
FIG. 3 is a partial elevation section taken on broken line 3—3 of FIG. 1 in the direction of the arrows and shows substantially the left hand side thereof, the right hand being a mirror image.

Referring to the drawing, a spray booth is shown incorporating my novel feature. As in the prior art, the spray booth has two side walls 11 and 12, an overhead 13, and an end wall 14 with suitable barn doors 15 and 16. At the opposite end from the barn doors there is a filtering wall 18 with standard filter elements 21 suitably supported within wall 18 in the standard manner. The side walls 11 and 12, the overhead 13 and end wall 14 with doors 15 and 16 are made, preferably, of standard parts, i.e., as shown in U.S. Pat. No. 2,445,074, except that the doors 15 and 16 are solid therein with no air filtering elements. As in the prior art, filtered air is drawn into the spray booth through the filtering wall 18 by a suitable fan 31 mounted within a vertical chimney 32. In turn, the lower end of chimney 32 communicates with a horizontal compartment 33 formed above overhead 13 by a U-shaped member 34 extending transversely thereon, as shown in FIG. 3. Within the spray booth and on each side of the doors 15 and 16 are disposed vertical compartments such as vertical compartment 41, as shown in FIG. 3. These compartments 41 have a portion of the side walls and of the end wall in common and have two filtering walls, such as walls 42 and 43 as shown in FIG. 3, with a plurality of filtering elements 44 suitably supported within the walls 42 and 43. Openings 51 and 52 are formed in overhead 13 to allow compartments 41 to communicate with compartment 33. Now one can understand that when an article such as an auto body is being spray painted within the booth, the doors 15 and 16 are closed to allow filtered air to enter through the filtering wall 18 and to be exhausted out of the chimney 32.

This prior art system works relatively good if the air entering through wall 18 is relatively clean, i.e., free of solid particles. Then the air within the booth is clean and a very good painted-finish is produced. The filters 44 at the opposite end by the doors prevents paint spray from being expelled into the atmosphere to preserve the ecology, as is common in the prior art.

Figure 4:
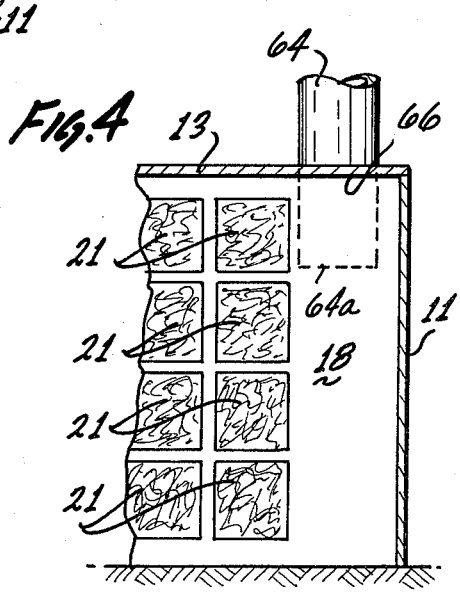
FIG. 4 is an elevation section taken on line 4—4 of FIG. 1 in the direction of the arrows and shows substantially the right hand side thereof, the left hand being a mirror image.

However, I have noticed that paint spray booths are usually set up in work areas where the surrounding air is relatively dirty. Then filtering elements 21 in wall 18 cannot do a very effective job of filtering while still allowing the use of a moderate powered exhaust fan and allowing a relatively long life for filters 21. As one skilled in the art knows, the more effective the filtering, i.e., removing the smaller size particles from the air, more energy is needed to move the air and more frequent changing of the filtering elements is required. Therefore, in my booth I have added an appendage 61 outside of the filtering wall 18 by extending side walls 11 and 12 and overhead 13 about two feet and adding a solid wall 62. Communicating with the interior of appendage 61 are two vertically disposed pipes 63 and 64 which pass through suitable openings 65 and 66, respectively, in overhead 13. The upper end of pipes 63 and 64 extends upward so that the upper end is preferably above the upper end of chimney 32 and also above the ambient surface or ground level dirt in the atmosphere. The lower end of each pipe 63 and 64 are extended down into appendage 61 so that the lower end is disposed above the floor 67, preferably more than half the distance above the floor 67 to the overhead 13. The pipes 63 & 64 are placed preferably near the respective side walls 11 & 12 and, in turn, no filtering elements 21 are placed in filtering wall 18 also near or adjacent the side walls 11 & 12 as shown in FIG. 4, thereby providing a pair of solid portions. FIG. 4 shows the lower end of pipe 64 by dash lines 64*a*. Pipe 63 is constructed similiar to pipe 64. This arrangement allows substantially all of the filtering elements 21 to pass substantially the same quantity of air for and even air flow distribution. The same reason is why I prefer to use two pipes 63 & 64 instead of one, although one pipe would be more economical. My spray paint booth operates as in the prior art except I have produced cleaner filtered air without the need of a stronger fan and finer filtering elements.

Having described the preferred embodiment of my invention, one skilled in the art, after reading the above description of the preferred embodiment of my invention, could devise other embodiments without departing from the spirit of my invention. Therefore, my invention is not considered to be limited to the disclosed embodiment, but includes all embodiments falling within the scope of the appended claims.

I claim:

1. A spray paint booth for a vehicle to be sprayed with paint said booth sitting on a floor and comprising:

a pair of parallelly disposed side walls, a pair of end walls and an overhead forming an enclosure;

one of said end walls having a door opening formed thereon;

a solid door assembly closing said door opening and providing access into said enclosure when said door assembly is open;

a first filtering wall disposed within said enclosure and spaced from and parallel to said other end wall to form an appendage therebetween;

said filtering wall extending to both side walls, said overhead and said floor;

means for allowing air to enter said appendage from a region outside said enclosure and said appendage;

second and third filtering walls disposed at right angles to each other and disposed within said enclosure adjacent said one end wall and on one side of said door opening to form, with said adjacent side wall, a first vertical compartment extending from said floor to said overhead;

fourth and fifth filtering walls disposed at right angles to each other and disposed within said enclosure adjacent said one end wall on the other side of said door opening from said first compartment to form, with said one end wall and said adjacent side wall, a second vertical compartment extending from said floor to said overhead;

a U-shaped member disposed over said overhead and over said first and second compartments to form a third compartment disposed horizontally;

said overhead having a pair of openings disposed over said first and second compartments so that said first, second and third compartments communicate with each other;

a vertical chimney extending from and communicating with said third compartment; and an exhaust fan disposed within said chimney to draw air out of said enclosure through either one of said first or second compartments and through said third compartment to exhaust said air out of said chimney so that the air, entering said enclosure through the said appendage, is filtered by said first filtering wall and the air, leaving said enclosure, is filtered by said second and third filtering walls and said fourth and fifth filtering walls.

2. The spray booth of claim 1 wherein said means for allowing said air to enter said appendage includes:

a vertical pipe extending upwards from said overhead above said appendage and communicating therewith.

3. In the booth of claim 2 wherein:

another vertically disposed pipe extends upward from said overhead over said appendage and communicates therewith and having its upper end terminating at a point above said enclosure.

4. In the booth of claim 3 wherein:

the lower end of both of said pipes is enclosed within said appendage and is disposed at a point located between the floor and the overhead.

5. In the booth of claim 4 wherein:

said pipes are disposed ajacent one of said side walls, and said filtering wall has a solid portion adjacent each of said side walls.

* * * * *